US005522644A

United States Patent [19]

Peek

[11] Patent Number: 5,522,644

[45] Date of Patent: Jun. 4, 1996

[54] VARIABLY ADJUSTABLE LOWER BODY SUPPORT FOR WHEEL CHAIR

[75] Inventor: Gregory A. Peek, Highlands Ranch, Colo.

[73] Assignee: LaBAC Systems, Inc., Highlands Ranch, Colo.

[21] Appl. No.: 110,579

[22] Filed: Aug. 23, 1993

[51] Int. Cl.[6] ..... A47C 7/52

[52] U.S. Cl. ..... 297/423.26; 297/423.35; 297/423.37; 403/359

[58] Field of Search ..... 297/423.26, 423.25, 297/423.35, 423.37; 403/359; 248/291

[56] References Cited

U.S. PATENT DOCUMENTS

| | | | |
|---|---|---|---|
| 252,169 | 1/1882 | Archer | 297/423.26 X |
| 1,279,120 | 9/1918 | Kellogg | 297/423.37 X |
| 1,490,649 | 4/1924 | Vanderbeek | 403/359 X |
| 1,721,221 | 7/1929 | Jauregui | 297/423.25 X |
| 2,755,055 | 7/1956 | Kreuscher | 248/291 |
| 3,380,097 | 4/1968 | Pharris | 403/359 X |
| 3,453,027 | 7/1969 | Pivacek | 297/423.37 |
| 4,949,928 | 8/1990 | Hoshino | 248/291 X |
| 4,957,303 | 9/1990 | Romatz | 297/423.26 X |
| 5,393,082 | 2/1995 | Fenley | 297/423.26 X |

FOREIGN PATENT DOCUMENTS

| | | | |
|---|---|---|---|
| 1110418 | 10/1955 | France | 248/241 |
| 821290 | 11/1951 | Germany | 403/359 |

OTHER PUBLICATIONS

Copy of portions of catalog entitled, *Technology That Works,* from Pin Dot Products—effective Jul. 1, 1987; pp. 22, 54–57.

Copy of portions of catalog entitled, *Wheelchair Seating Accessories and Hardware,* from Otto Bock Orthopedic Industry; pp. 1, 26, 28.

*Primary Examiner*—James R. Brittain
*Assistant Examiner*—David E. Allred
*Attorney, Agent, or Firm*—Holland & Hart

[57] ABSTRACT

A pair of variably adjustable lower body supports such as footnests or legrests are adapted to be mounted on a wheel chair. Each support is mounted on one of two tubular receptacles on the front of the frame of the wheel chair. The support includes four elongated structural members and a planar footplate. Each of the structural members are sequentially linked together by a releasable rotary connection. The releasable rotary is formed by a splined shaft attached to one structural member and a splined sleeve attached to the next structural member. A releasable fastening device is used to hold the splined sleeve onto the splined shaft so that the sleeve can be selectively rotated relative to the shaft angular of the support and footplate relative to the wheel chair frame.

8 Claims, 6 Drawing Sheets

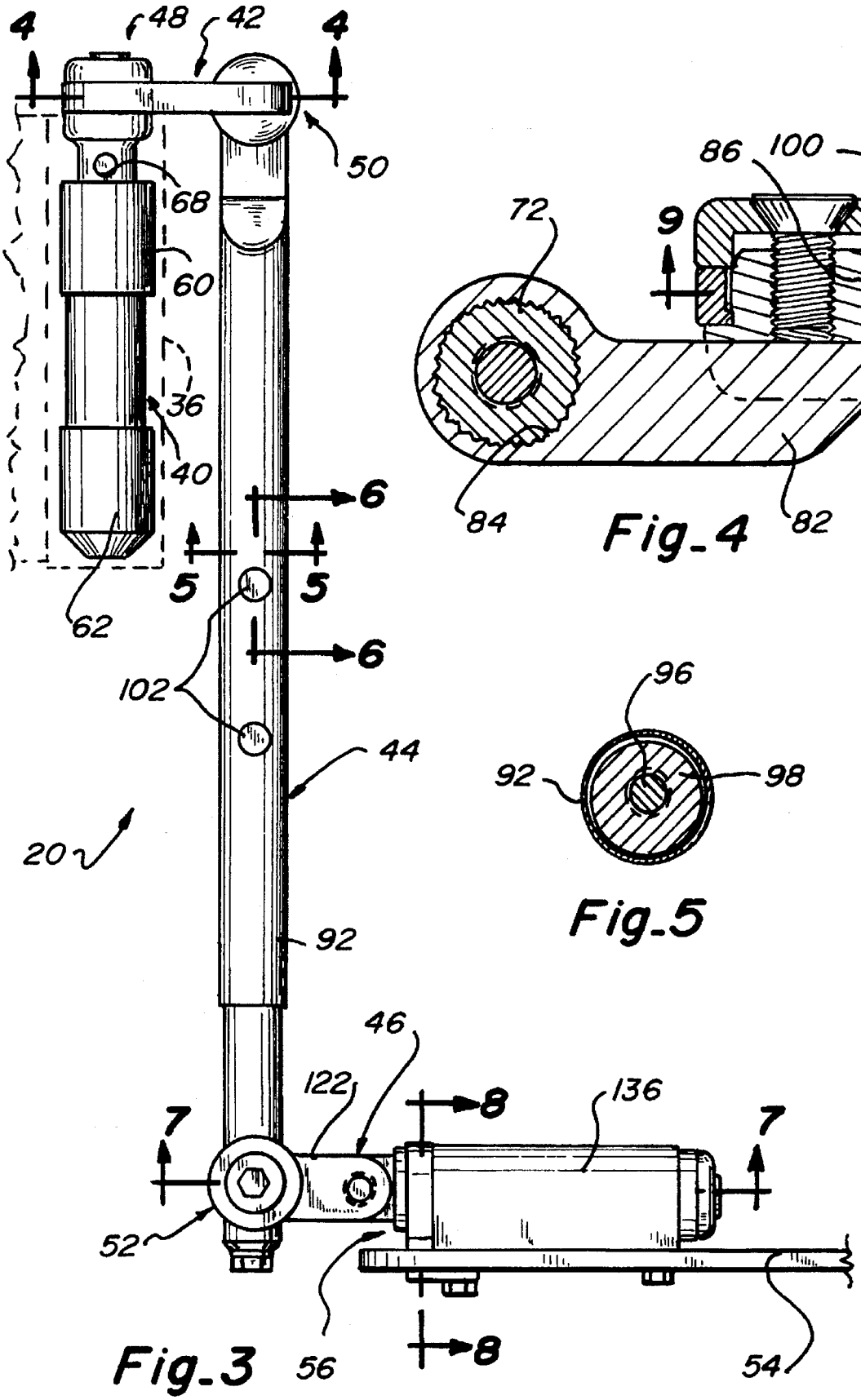
Fig_3
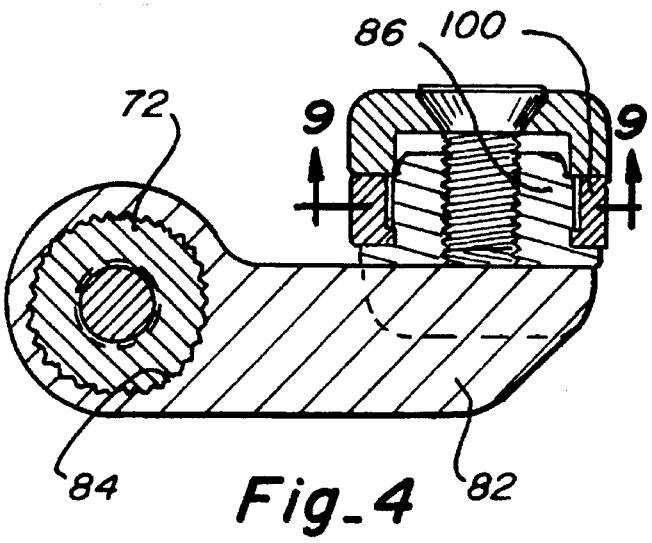
Fig_4
Fig_5

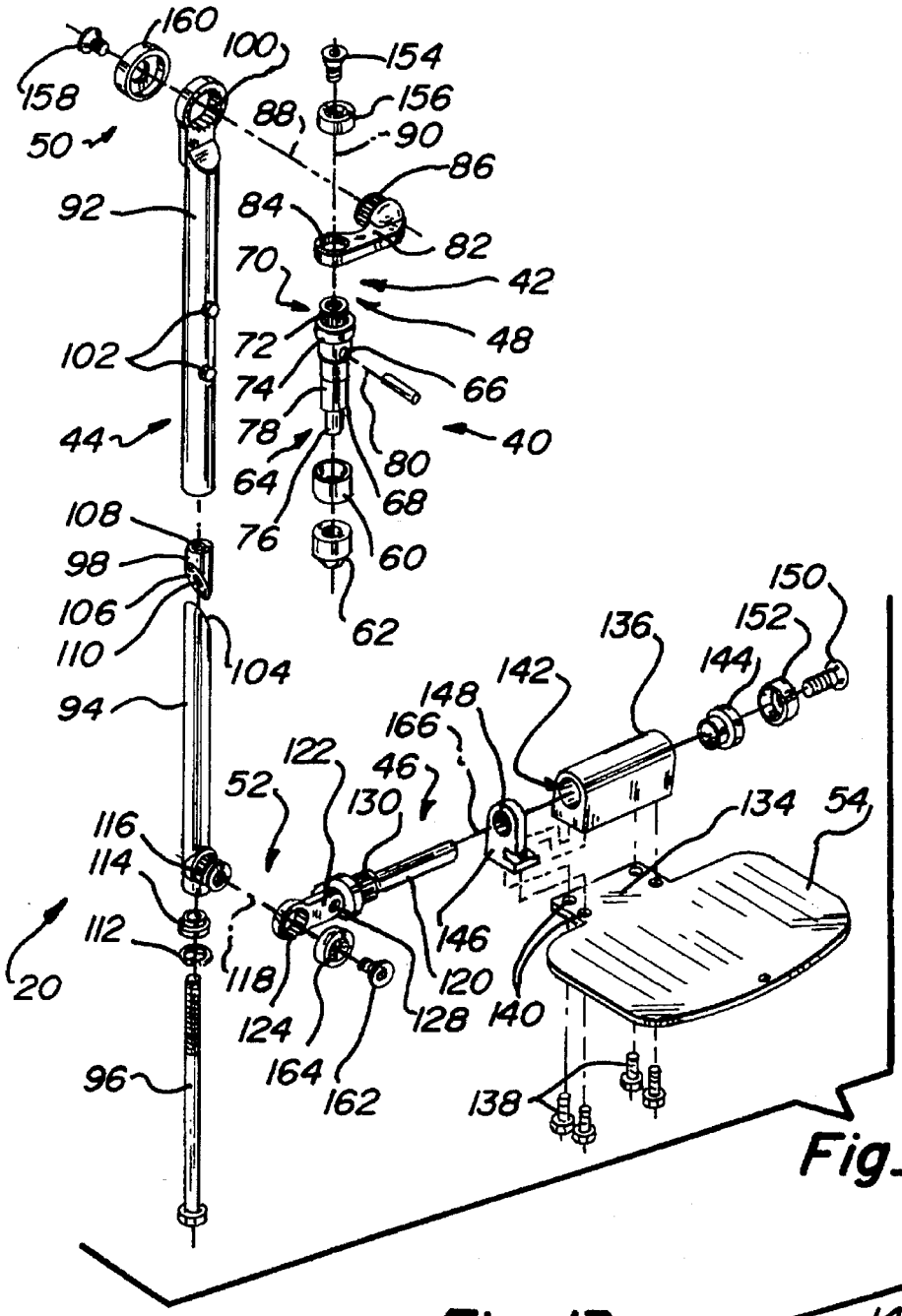
Fig. 12
Fig. 13
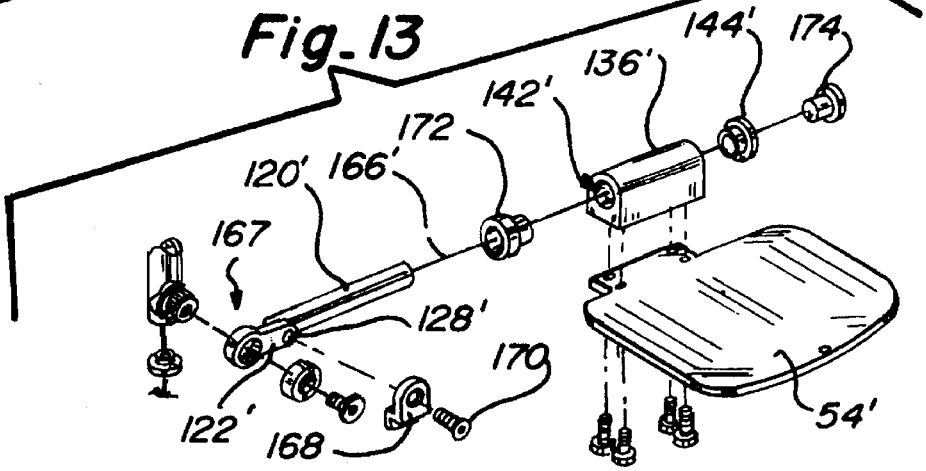

VARIABLY ADJUSTABLE LOWER BODY SUPPORT FOR WHEEL CHAIR

BACKGROUND OF THE INVENTION

1. Field of the Invention

The present invention relates generally to lower body supports such as footrests and legrests for wheel chairs and, more particularly, to a new and improved footrest/legrest including components for facilitating adjustments about a multitude of axes to desirably position the footrest/legrest to accommodate multiple deformities and for specific lower extremity needs.

2. Discussion of Prior Art

Wheel chairs commonly include a frame to which four wheels, a seat bottom, a seat back, arm rests and push handles are attached. The four wheels typically include two large rear drive wheels and two smaller front idler wheels. On the front of the frame, below the seat bottom, there is typically a pair of hangers, receivers, or receptacles for attaching a pair of lower body supports thereto. A typical hanger includes a pair of hooks from which a footrest/legrest can be hung.

The simplest arrangement of a footrest may include a rod with a footplate attached to the rod. In addition, the connection between the rod and the footplate may be such that the footplate may freely pivot from a fixed generally horizontal position to a substantially vertical position to allow the occupant to easily enter and exit the chair or to allow the chair to collapse into a more convenient size or shape for transport. The simplest arrangement of a legrest may include a rod extending horizontally out from the wheelchair with a calf support attached to the rod.

For a variety of reasons, it may be desirable to adjust and fix the footrest/legrest, and thus the occupant's leg and foot, in various positions relative to the wheel chair. In the past, this has been accomplished to some degree with rotary connections by providing some adjustment of the footrest/legrest about an axis corresponding to the pivotal axis of the occupant's knee. Some adjustment of the footplate has also been provided about an axis corresponding to the pivotal axis of the occupant's ankle.

However, there are several shortcomings to these prior art approaches. First of all, the footplate has typically been connected to the main rod via a horizontal rod and a band clamp around the horizontal rod which relied upon frictional force to retain the footplate in position relative to the horizontal rod. As will be appreciated, pressure from the weight of the leg and foot placed at either end of the footplate causes a great amount of rotational force due to the leverage involved and thereby allows the clamp to easily slip, allowing the footplate to rotate out of the desired position.

A second shortcoming in the prior art involves the rotary connection allowing for adjustment about the knee axis. This knee axis adjustment has typically been accomplished by an unreliable rotary connector between structural members of the footrest/legrest. The connector included a pair of opposed faces having serrations therein. These two face-serrations were held against each other by a fastening bolt. The drawback with face-serration connectors is that rotational forces, such as those caused by the weight of the leg, tend to cause the connector to loosen. Once loosened partially, the continued application of force will effect further rapid loosening.

A third shortcoming of the prior art is the inability to achieve a large variety of footrest/legrest orientations relative to the wheel chair which is desirable to accommodate different deformities and to achieve varied positioning of the legrest for specific purposes.

It is against this background and to overcome the shortcomings of the prior art that the present invention has been developed.

SUMMARY OF THE INVENTION

The adjustable lower body support of the present invention is adapted to be mounted on a frame of a wheel chair which also includes a seat and supporting wheels. The support has a plurality of structural members including four elongated members and a planar footplate. The structural members are operatively linked together by releasable connections which are each variably adjustable to place each of the elongated members and the footplate in various angular orientations relative to each other member.

Another feature of the adjustable support of the present invention is a rotary connection for use between the elongated members and the footplate and which includes a splined shaft oriented along a rotational axis of the rotary connection and defined by one of the structural members of the support, a splined sleeve also oriented along the rotational axis and defined by another of the structural members, and a fastening member for operatively connecting the splined sleeve to the splined shaft at selected angular orientations. By providing such a rotary connection, the support is adjustable to a variety of orientations in a convenient fashion. Furthermore, the support is held in position in a reliable fashion due to the positive interconnection of the splined shaft and splined sleeve.

Yet another feature of the adjustable support of the present invention includes a rotary connection between each succeeding structural member such that the support is adjustable about at least two rotational axes which are not parallel to each other. By providing adjustment about at least these two non-parallel axes, a great deal of positional orientations are available for the support. Other aspects, features and details of the present invention can be more completely understood by reference to the following detailed description of the preferred embodiment, taken in conjunction with the drawings, and from the appended claims.

DETAILED DESCRIPTION OF THE DRAWINGS

FIG. 3 is a side view of the first embodiment of the variably adjustable support of the present invention.

FIG. 4 is a section taken along line 4—4 of FIG. 3.

FIG. 5 is a section taken along line 5—5 of FIG. 3

FIG. 12 is an exploded isometric view of the first embodiment of the variably adjustable support of the present invention.

FIG. 13 is an exploded isometric view of the second embodiment of the variably adjustable support of the present invention shown in FIG. 11.

DESCRIPTION OF THE PREFERRED EMBODIMENT

Figure 1:
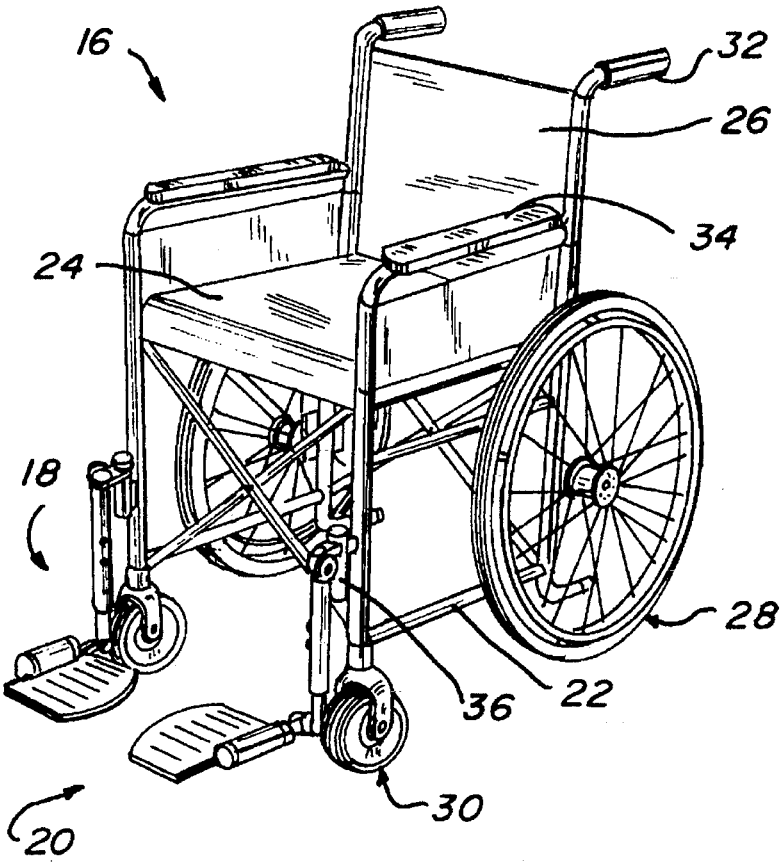
FIG. 1 is an isometric view of a wheel chair including a pair of the variable adjustable lower body supports of the present invention.

The variably adjustable lower body support of the present invention is adapted to be mounted on a wheel chair 16. As shown in FIG. 1, a right-footed footrest 18 and a left-footed footrest 20 are provided to correspond with the occupant's two feet. Since the two footrests are mirror images of each other, only the left-footed footrest is described further herein.

The wheel chair 16 includes a frame 22 to which a seat bottom 24 and seat back 26 are mounted, as shown in FIG. 1. The wheel chair is supported by a pair of rear, manually-driven wheels 28 and a pair of front idler wheels 30. Alternatively, in the case of a powered wheelchair, these wheels may be driven by a motor (not shown). For convenience and comfort, the wheel chair is also provided with a pair of push handles 32 attached to the frame adjacent to the seat back and a pair of arm rests 34 on the frame disposed on either side of the seat bottom. On the front of the frame located below the front edge of the seat bottom are a pair of open-topped, vertically-extending hollow, cylindrical, tubular receptacles 36 for receiving the footrest 20. The receptacles each have a longitudinal vertical notch 38 (FIG. 14) formed at the top side thereof. To accommodate other wheelchairs with differently-shaped receptacles, an adapter (not shown) can be used.

Figure 2:
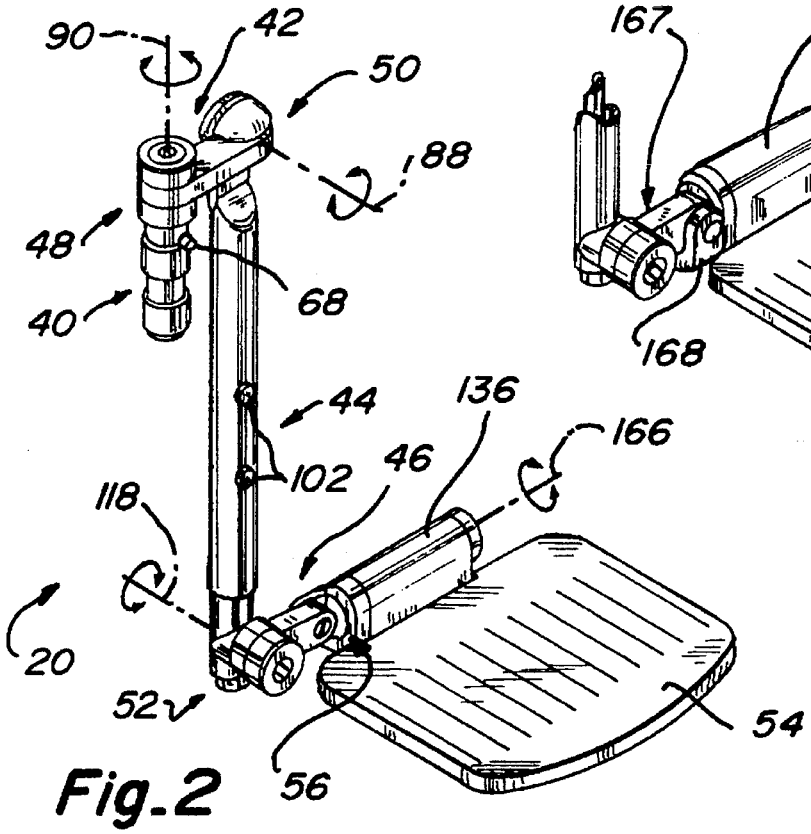
FIG. 2 is an isometric view of a first embodiment of the variably adjustable support of the present invention.

The footrest 20 includes first, second, third, and fourth elongated structural members 40, 42, 44 and 46 respectively, as shown in FIGS. 2, 3 and 12. These four members are linked together sequentially by first, second, and third releasable rotary connections or connectors 48, 50 and 52 respectively. A fifth member, a planar footplate 54, is connected to the fourth member by a fourth releasable rotary connection or connector 56.

The first elongated member 40, best seen in FIGS. 2, 3 and 12, is a relatively short, cylindrical member, or footrest post, having an upper sleeve bushing 60 located thereon and a lower bushing 62 located on a lower end 64 thereof, as shown in FIG. 12. The bushings 60 and 62 may be composed of Delrin, an acetyl polymer. The footrest post has a radial hole 66 therein into which a locating pin 68 is fixably placed. The locating pin protrudes from the footrest post and operates to pivotally and releasably fix the footrest post within the hollow receptacle 36 when positioned within the longitudinal notch 38 in the receptacle. The upper end 70 (FIG. 12) of the footrest post defines a splined shaft 72 having a multitude of longitudinally-extending, parallel, raised ridges or serrations about the outer circumference thereof, as shown in FIG. 4. Located longitudinally adjacent to the splined shaft is a coaxial circumferential shoulder 74 having a greater diameter than the splined shaft (FIG. 12).

The upper and lower bushings 60 and 62 are frictionally fit onto the post 40. The lower end 64 of the post 40 includes a relatively small diameter cylindrical neck 76 which has an outer diameter nearly equal to the internal diameter of the lower bushing. Located vertically above the neck on the post is a cylindrical first region 78 having an outer diameter significantly greater than that of the neck. Located vertically above the first region on the post but below the radial hole 66 is a cylindrical second region 80 having an outer diameter slightly larger than that of the first region and nearly equal to the internal diameter of the upper sleeve bushing 60. Thus, when mounting the upper bushing on the post 40, it is slid upwardly over the neck and first region and frictionally seated on the second region. Similarly, the lower bushing is slid upwardly onto the neck and frictionally seated on the post.

Figure 9:
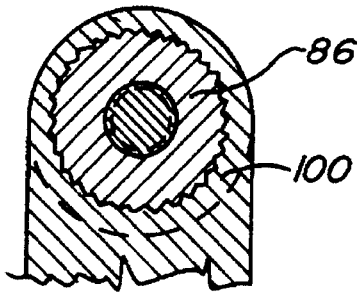
FIG. 9 is a section taken along line 9—9 of FIG. 4.
Figure 8:
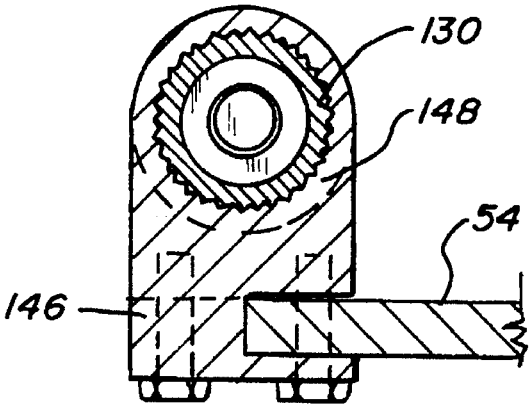
FIG. 8 is a section taken along line 8—8 of FIG. 3.
Figure 14:
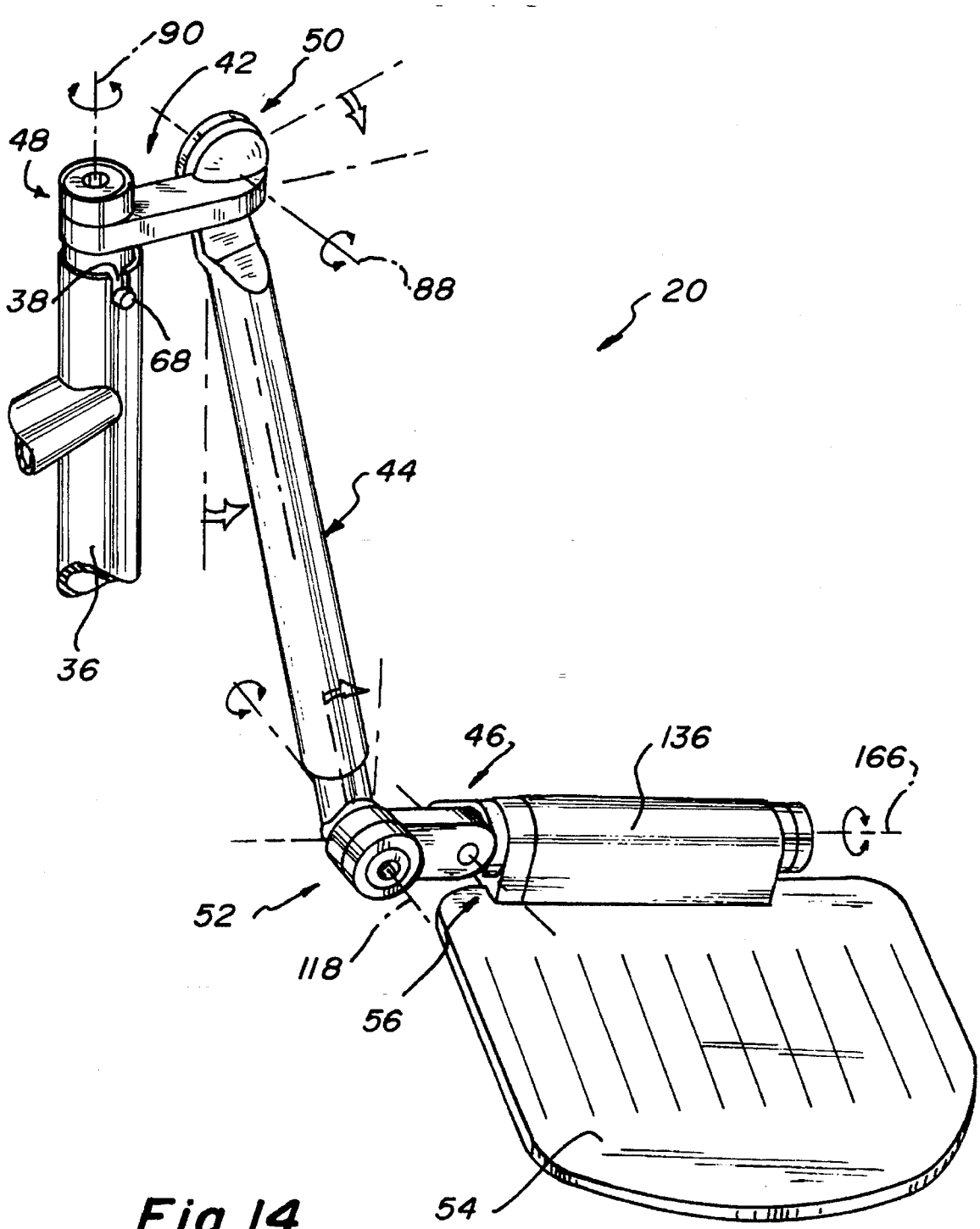
FIG. 14 is an isometric view of the first embodiment of the variably adjustable support of the present invention showing the rotational axes of each of the rotary connections.

The second elongated member 42, or upper adjustable arm weldment as shown in FIG. 12, is horizontally oriented and has a body in the form of a generally flat bar 82 having a splined sleeve 84 at a first end (FIG. 4) and a splined shaft 86 at a second end. The splined sleeve includes a substantially circular opening through the weldment having a multitude of parallel, raised ridges or serrations along the inner surface of the opening. The splined sleeve of the upper adjustable arm weldment is sized to snugly fit over the splined shaft 72 of the footrest post 40. The serrations of the splined sleeve are thus located between the serrations of the splined shaft and the fit is sufficiently snug so that the splined sleeve cannot be rotated relative to the splined shaft. The splined shaft 86 protrudes transversely from the bar (FIGS. 4, 9 and 12). A central axis 88 of the splined shaft at the second end of the bar is orthogonal to a central axis 90 of the splined sleeve at the first end of the weldment (FIG. 4 and 14). The splined shaft of the weldment is similar in shape to the splined shaft of the footrest post, having a multitude of serrations about the outer surface thereof. The term orthogonal is used in this application to describe the relationship between two perpendicular lines lying in the same plane as well as the relationship between two lines lying in different planes where, when viewed along a third line which passes through and is perpendicular to each, the two lines appear to be perpendicular to each other.

Figure 6:
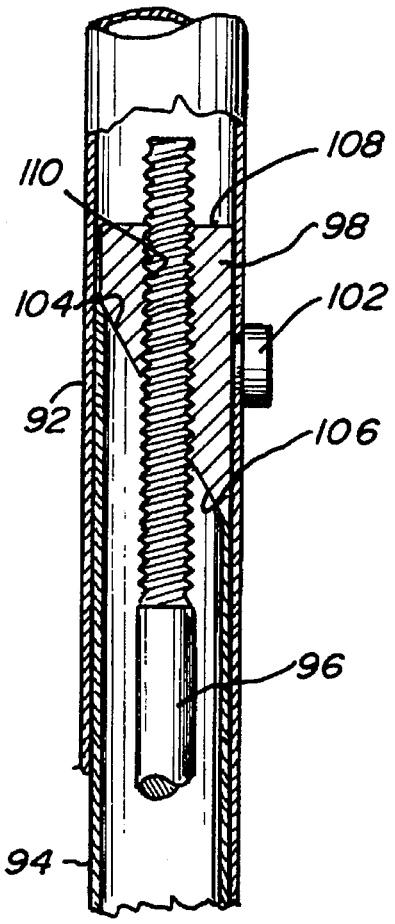
FIG. 6 is a section taken along line 6—6 of FIG. 3.

The third elongated structural member 44, shown in FIG. 12, includes an upper and a lower footrest weldment 92 and 94 respectively which are held in place in a longitudinally adjustable manner by an internally located bolt 96 and tube wedge 98. The upper footrest weldment is a hollow, cylindrical tube having a transversely-opening splined sleeve 100 at an upper closed end thereof (FIGS. 4, 9 and 12). The splined sleeve is similar in shape to the splined sleeve 84 on the upper adjustable arm weldment 42, having a multitude of serrations along its inner surface. The splined sleeve is sized to fit snugly on the splined shaft 86 of the upper adjustable arm weldment 82 so as to prevent rotation of the sleeve 100 relative to the shaft 86 (FIGS. 4 and 9). A second or lower end of the upper footrest weldment is open, allowing access to the interior of the hollow upper footrest weldment (FIGS. 3, 6 and 12). Located on the outer surface of the upper footrest weldment are two external, axially spaced, radially protruding buttons 102 which can be used in a conventional manner to attach other pieces of hardware such as calf supports to the footrest, as described below.

The lower footrest weldment 94 is a hollow, cylindrical tube having an outside diameter which is slightly smaller than the inside diameter of the upper footrest weldment 92

(FIG. 6) so as to be telescopically receivable therein. The upper end and lower end of the lower footrest weldment are both open to allow access to the interior thereof. An upper edge 104 of the lower footrest weldment is cut at an oblique angle to the longitudinal axis for a purpose which will become more clear hereafter.

The tube wedge 98 is also a hollow tubular member sized to slidably fit within the upper footrest weldment 92. It has its lower edge 106 cut at an oblique angle to its longitudinal axis similar to that of the angle on the upper edge 104 of the lower footrest weldment 94 and its upper edge 108 cut at a right angle to its longitudinal axis. The two oblique edges are adapted to mate with each other. The tube wedge has an internally threaded inner bore 110 (FIG. 12) which is adapted to threadedly receive the externally threaded bolt 96 after the bolt is passed through the open lower end of the lower footrest weldment (FIG. 12). A split lock washer 112 and a flanged washer 114 are placed over the bolt before insertion into the lower footrest weldment and tube wedge.

Due to the reaction along the oblique faces of the tube wedge and lower footrest weldment as the bolt is screwed into the tube wedge, the tube wedge and the lower footrest weldment are axially drawn toward each other thereby camming each slightly laterally away from the longitudinal axis of the upper footrest weldment to bring portions of the external surfaces of the tube wedge and lower footrest weldment into frictional contact with the inner surface of the upper footrest weldment (FIG. 6). In this manner, the relative axial positions of the upper and lower footrest weldments can be positively adjusted.

Figure 7:
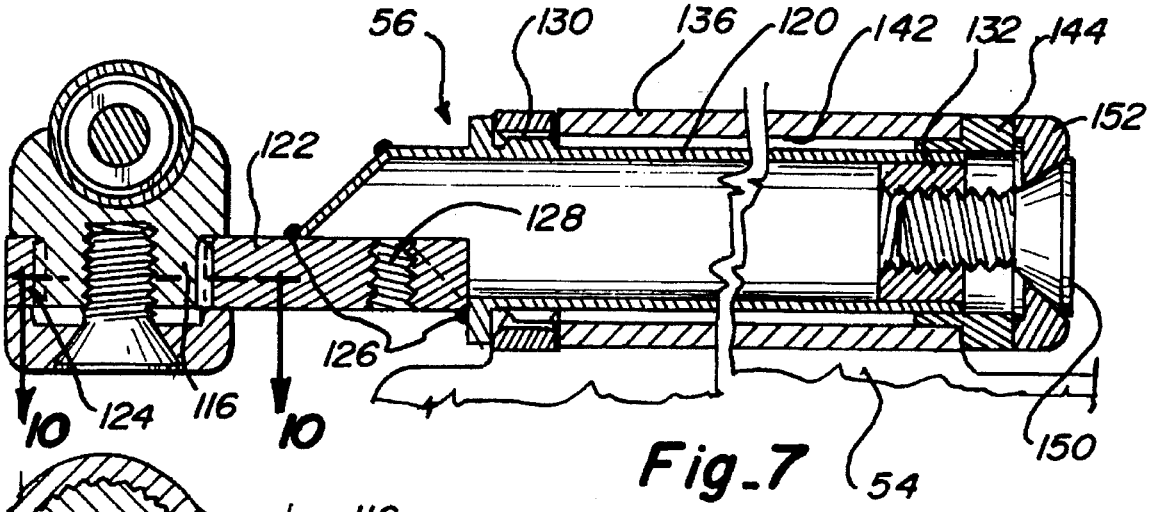
FIG. 7 is a section taken along line 7—7 of FIG. 3.

The lower end of the lower footrest weldment has a radially or transversely directed splined shaft 116 shaped similarly to the splined shaft 86 of the upper adjustable arm weldment 42 having a multitude of serrations about the outer surface thereof (FIGS. 7 and 12). The splined shaft 116 has a central axis 118 orthogonal to the longitudinal axis of the lower footrest weldment (FIGS. 7, 12 and 14). The central axis of the splined shaft 116 is parallel with the central axis 88 of the splined sleeve 100 at the upper end of the upper footrest weldment 92 (FIGS. 12 and 14).

Figure 10:
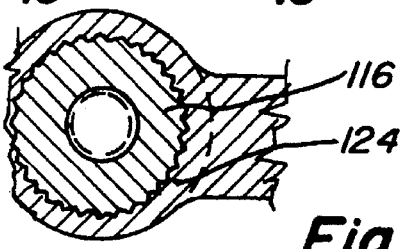
FIG. 10 is a section taken along line 10—10 of FIG. 7.

The fourth elongated member 46, or lower adjustable arm weldment, is an integral combination of a generally cylindrical elongated hollow tube 120 and a generally flat arm 122, as shown in FIGS. 7 and 12. The flat arm has a splined sleeve 124 defining a horizontal opening at a first end and a weld connection 126 to the cylindrical tube 120 at a second end (FIG. 7). The splined sleeve is similar in shape to the splined sleeve 84 on the first end of the upper adjustable arm weldment 42, having a multitude of serrations along its inner surface. The splined sleeve is sized to fit snugly on the splined shaft 116 of the lower footrest weldment 94 so as to prevent rotation of the sleeve 124 relative to the shaft 116 (FIGS. 7 and 10). A horizontally-opening threaded hole 128 is also provided through the arm 122 near its second end for a purpose to be described later. Near the end of the cylindrical tube 120 which is welded to the arm 122, a sleeve having a splined outer surface is welded onto the external surface of the tube so as to define a splined shaft 130 (FIGS. 7 and 12). The splined shaft is shaped and sized similarly to the previously described splined shafts 72, 86 and 116, having a multitude of serrations on the outer surface thereof. The second open end of the cylindrical tube 120 has an internally-threaded nut 132 (FIG. 7) welded therein for a purpose that will become more clear later.

The planar footplate 54 has a lateral extension flange 134 along a side edge thereof for attachment of a pivot block 136 (FIG. 12). The pivot block is attached to the footplate by four bolts 138 with each passing upwardly through one of four openings 140 in the flange to align with corresponding openings (not shown) in the bottom face of the pivot block. The pivot block has a longitudinal, internal bore 142 therethrough which is parallel with the planar face of the footplate and receives a bushing 144 at a first end. An adjustable mechanical stop 146 is attached to the footplate and the opposite end of the pivot block. The stop has an opening therein having a splined sleeve 148 shaped similarly to the previously described splined sleeves 84, 100 and 124, having a multitude of serrations along its inner surface. The stop is mounted on the footplate by two of the previously described bolts 138 which attach the footplate to the pivot block. The pivot block is slid onto the cylindrical tube 120 of the lower adjustable arm weldment 146 so that the splined sleeve of the stop 146 engages the splined shaft 130 on the cylindrical tube and the bushing 144 rotatably supports the cylindrical tube. The splined sleeve of the stop is sized to fit snugly over and mate with the splined shaft on the cylindrical tube. Thus, pivotal movement of the footplate is dependent on pivotal movement of the mechanical stop which is controlled by the splined connection of the tube 120 with the mechanical stop. The pivot block and splined sleeve 148 of the mechanical stop are held in place on the splined shaft of the lower adjustable arm weldment by a screw 150 and retaining cap 152, with the screw being axially inserted through the bushing 144 into the threaded weld nut 132 in the open second end of the cylindrical tube 120.

The first releasable connection 48, including the splined shaft 72 of the footrest post 40 and the splined sleeve 84 of the upper adjustable arm weldment 42, is held together by a screw 154 and retaining cap 156 as shown in FIG. 12. By loosening the screw, the splined sleeve can be slid axially along its central axis 90 off the splined shaft and placed into a new rotational location on the splined shaft thus allowing for adjustment about a longitudinal axis coaxial with the central axis 90 of the footrest post. This first rotational axis is defined as the rotational hanger interface axis.

The second releasable connection 50 including the splined shaft 86 of the upper adjustable arm weldment 42 and the splined sleeve 100 of the upper footrest weldment 92 is similarly releasably held in place by a screw 158 and a retaining cap 160. By loosening this screw and repositioning the splined sleeve of the upper footrest weldment, the upper footrest weldment can be adjusted to various rotational orientations relative to the central axis 88 of the splined shaft of the upper adjustable arm weldment. These rotational orientations are about a second axis, or knee axis. The knee axis is orthogonal to the rotational hanger interface axis 90.

The third releasable connection 52 including the splined shaft 116 of the lower footrest weldment 94 and the splined sleeve 124 of the lower adjustable arm weldment 46 is releasably held in place by a screw 162 and retaining cap 164 in a similar fashion. The lower adjustable arm weldment can be placed in various rotational orientations relative to the lower footrest weldment by loosening the screw 162 and repositioning the splined sleeve of the lower adjustable arm weldment relative to the central axis 118 of the splined shaft of the lower footrest weldment. This adjustment is about a third axis, referred to as the ankle axis. The ankle axis is parallel to the knee axis 88 and orthogonal to the rotational hanger interface axis 90.

The splined sleeve 148 of the adjustable mechanical stop 146 and the splined shaft 130 of the lower adjustable arm weldment 46 together define the fourth releasable connection 56 which provides for adjustment about a fourth axis 166, referred to as the foot axis, as shown in FIG. 14.

Figure 11:
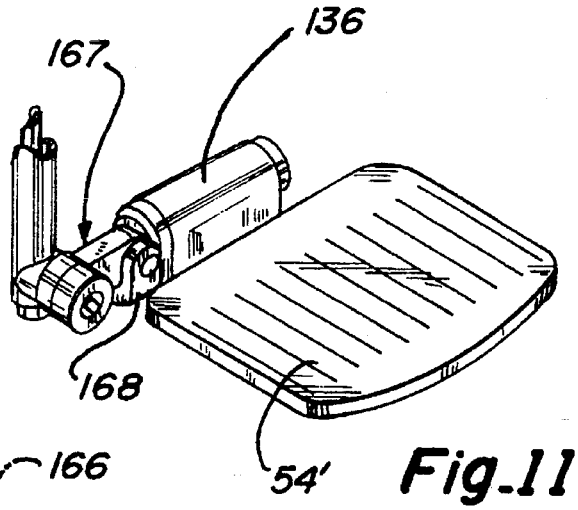
FIG. 11 is a fragmented isometric view of a portion of a second embodiment of the variably adjustable support of the present invention.

A second embodiment of the footplate mounting is shown in FIGS. 11 and 13 with like parts having been given like reference numerals with a prime suffix. This embodiment allows a footplate 54' to pivot freely about a longitudinal axis 166' of a lower adjustable arm weldment 167. In this embodiment, the lower adjustable arm weldment includes a flat arm 122' attached to a cylindrical tube 120'. In this embodiment, the cylindrical tube does not have a sleeve slidably inserted and welded thereon to form the splined shaft 130, nor does this embodiment have the internally-threaded weld nut 132. Rather, this embodiment has a fixed mechanical stop 168 attached to the flat arm 122' of the lower adjustable arm weldment by a screw 170 passed through an opening in the fixed mechanical stop and threadedly inserted into an internally-threaded opening 128' in the flat arm. A pivot block 136' and the footplate 54' are not attached to the previously-described adjustable mechanical stop 146 having the splined sleeve 148 defined therein, but instead the pivot block is provided with a first bushing 144' and a second bushing 172 inserted in opposite ends of a longitudinal bore 142'.

The pivot block 136' can then be slid onto the cylindrical tube 120' of the lower adjustable arm weldment 167 to pivotally support the cylindrical tube in the bushings 144' and 172. The pivot block and attached footplate 54' are held on the cylindrical tube by a retainer plug 174 inserted through the first bushing 144' and frictionally held within the open end of the cylindrical tube of the lower adjustable arm weldment. The pivotal movement of the footplate and pivot block about the lower adjustable arm weldment is limited only by the fixed mechanical stop 168 attached to the lower adjustable arm weldment. Accordingly, the footplate can be freely pivoted from a vertical position (not shown) in one direction toward a substantially horizontal position, at which point the pivotal movement is halted by the stop so as to hold the footplate in the preferred horizontal position as shown in FIG. 11. Similarly, pivotal movement in the opposite direction is limited by the stop so that the footplate cannot pivot in that direction past the vertical position.

As can be appreciated, and as is partially shown in FIG. 14, adjustment about these multiple parallel and non-parallel axes 88, 90, 118 and 166 provides for a great latitude of footplate positioning relative to the wheel chair 16. Because of this, the footrest 20 can more easily and conveniently accommodate occupants having a variety of needs. Furthermore, the nature of the splined shaft/splined sleeve releasable connectors 48, 50, 52 and 56 provides a reliable connection that can withstand the reasonably expected forces on the connections so as to maintain the desired position.

The footrest described above may be modified to have any combination of the above described components as more or less adjustability may be desirable. For example, the rotary connection 50 about axis 88 (FIG. 2) may be eliminated in specific applications where it is not necessary and it is desirable to provide a lower cost footrest.

The above description has been provided for a footrest 20 to mount on a hollow tubular receptacle 36. However, there currently exists wheel chairs which have hangers, receivers or receptacles (none of which are shown) which have a different shape than this hollow tubular receptacle. Accordingly, it may be desirable to provide adapters (not shown) in a conventional manner so that the above described variably adjustable footrests 18 and 20 of the present invention can interact with and be mounted on wheel chairs having these various hangers, receivers and receptacles.

Figure 15:
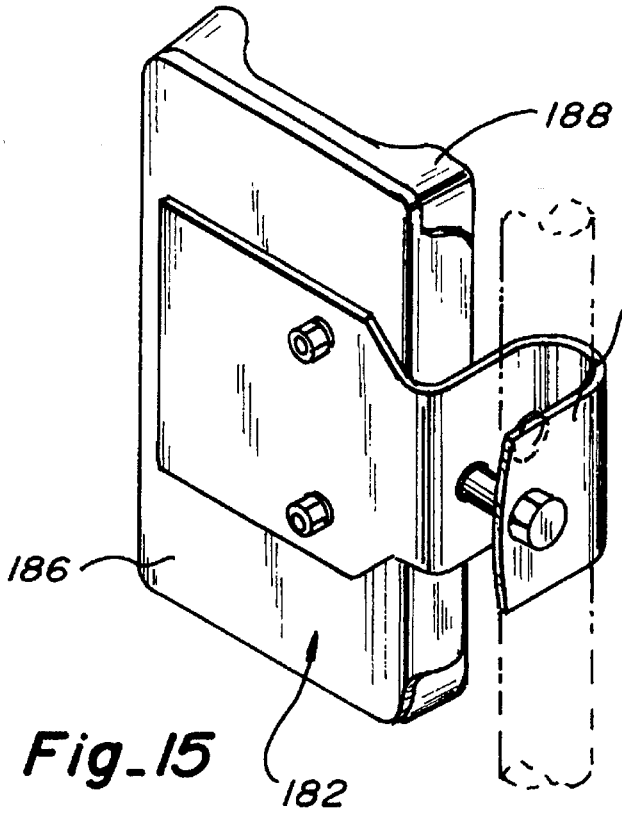
FIG. 15 is an isometric view of a portion of a third embodiment showing a legrest trough for employing the present invention as a legrest.
Figure 16:
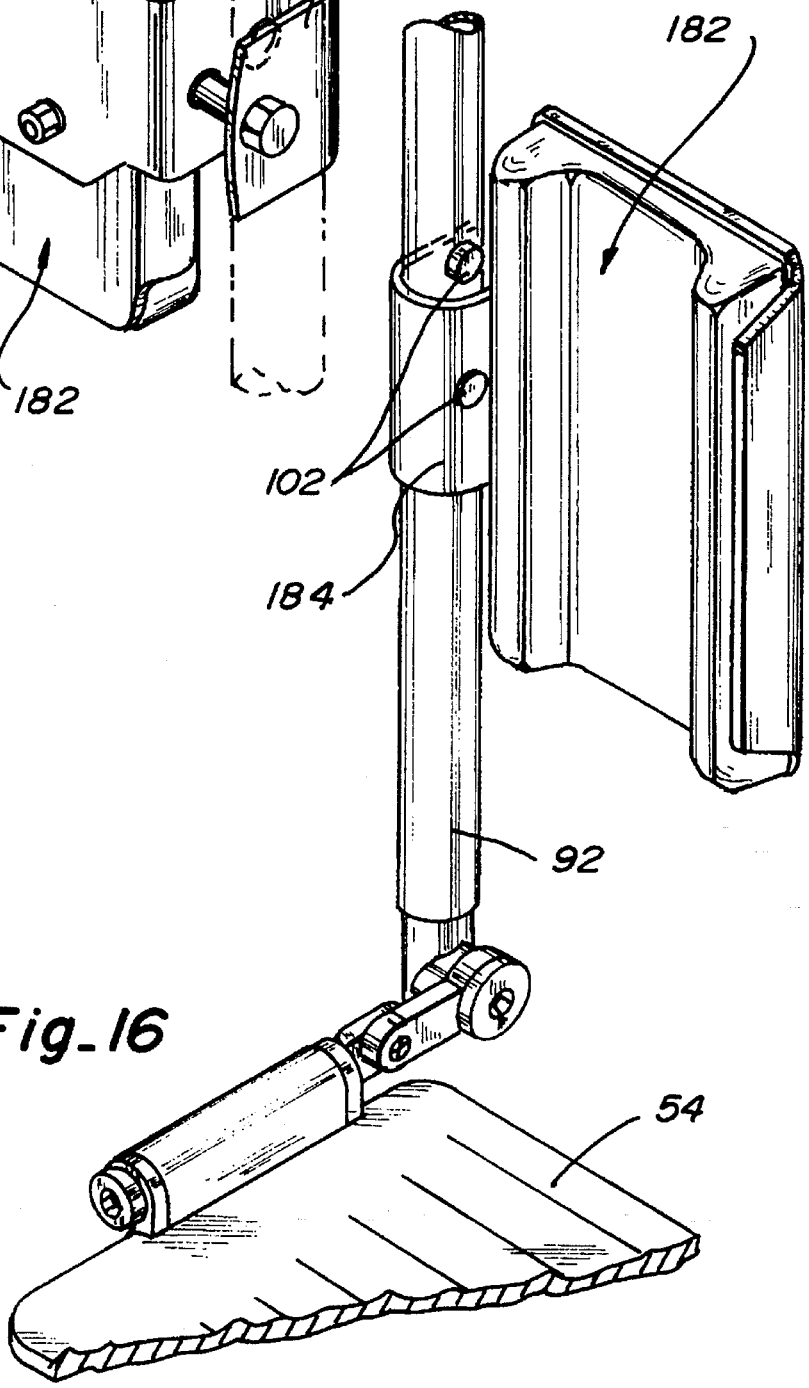
FIG. 16 is an isometric view of the legrest trough of FIG. 15 installed on an upper footrest weldment.

The above described footrest can be modified as shown in FIGS. 15 and 16 to provide a calf support. The modification includes a trough 182 and a metal bracket 184. The trough includes a baseplate 186 to which a u-shaped foam pad 188 is attached. The bracket defines a circular opening therein to mate with either of the two external, axially spaced, radially protruding buttons 102 on the upper footrest weldment 92 for attachment of the trough. The footplate 54 described above may or may not be used with this legrest.

A presently preferred embodiment of the present invention has been described above with a degree of specificity. It should be understood, however, that this degree of specificity is directed toward the preferred embodiment. The invention itself, however, is defined by the scope of the appended claims.

The invention claimed is:

1. An adjustable lower body support for a wheelchair having a frame including a seat and a plurality of wheels operatively attached to the frame, said support mountable on a receptacle on the frame, comprising:

a first elongated member mountable on the receptacle and having a longitudinal axis;

a second elongated member having a longitudinal axis substantially orthogonal to the longitudinal axis of said first elongated member and a transverse axis orthogonal to its longitudinal axis, an adjustable releasable connector securing said second member to said first member for adjustments of said second member about the longitudinal axis of said first member;

a third elongated member having a longitudinal axis substantially orthogonal to the transverse axis of said second member and a transverse axis orthogonal to its longitudinal axis, an adjustable releasable connector securing said third member to said second member for adjustment of said third member about the transverse axis of said second member;

a fourth elongated member having a longitudinal axis substantially orthogonal to the transverse axis of said third member, an adjustable releasable connector securing said fourth member to said third member for adjustment of said fourth member about the transverse axis of said third member; and a substantially planar footplate operatively attached to said fourth member.

2. An adjustable support as defined in claim 1 wherein said substantially planar footplate has a first axis substantially parallel to the longitudinal axis of said fourth member, and a releasable adjustable connector securing said footplate to said fourth member for adjustment about the longitudinal axis of said fourth member.

3. An adjustable support as defined in claim 2 further comprising a stop attached to said fourth member for engagement by said footplate for limiting the pivotal movement of said footplate about the longitudinal axis of said fourth member.

4. An adjustable support as defined in claim 1 wherein said first, second and third releasable connections are variably adjustable to predetermined, fixed, angular orientations about the longitudinal rotational axis of said each connection.

5. An adjustable support as defined in claim 4 wherein said first, second and third releasable connections each comprise:

a splined shaft on one member;

a splined sleeve on another member; and a fastener operatively connecting said splined sleeve to said splined shaft at a selected angular orientation.

6. An adjustable lower body support for a wheelchair having a frame including a seat and a plurality of wheels operatively attached to the frame, said support mountable on a receptacle on the frame and comprising:

multiple structural members connected together by a plurality of releasable rotary connectors each adjustable about a rotational axis to place the members in varied angular orientations relative to each other, each said rotary connector comprising:

a splined shaft oriented along a rotational axis;

a splined sleeve oriented on said rotational axis of said shaft; and a fastener operatively securing said splined sleeve to said splined shaft at selected angular orientations, and wherein the rotational axes of at least two connectors are parallel and the rotational axes of at least two connectors are not parallel to each other.

7. An adjustment support as defined in claim 6 wherein at least three of the rotational axes of said rotary connectors are not parallel to each other.

8. An adjustment support as defined in claim 6 including five said structural members.

* * * * *